United States Patent [19]

Boelter, Jr.

[11] Patent Number: 5,024,445

[45] Date of Patent: Jun. 18, 1991

[54] METHOD OF PLAYING A BOARD GAME

[76] Inventor: John D. Boelter, Jr., 1114 Benton Way, Arden Hills, Minn. 55112

[21] Appl. No.: 774,131

[22] Filed: Sep. 9, 1985

[51] Int. Cl.[5] ..... A63F 9/04

[52] U.S. Cl. ..... 273/256; 273/246

[58] Field of Search ..... 273/256, 275, 281, 243, 273/246, 249

[56] References Cited

U.S. PATENT DOCUMENTS 3,481,605 12/1969 Giraurd et al. ..... 273/246

*Primary Examiner*—Edward M. Coven

*Attorney, Agent, or Firm*—Grady J. Frenchick

[57] ABSTRACT

A board game apparatus and method are disclosed. The board game and method have a transportation motif, a railroad motif being preferred. In its preferred practice, play of the game involves completion of a plurality of shipments or deliveries of commodities to a plurality of destinations. A novel method of playing the board game is disclosed which involves placement of described means to avoid various strategically determined consequences.

6 Claims, 1 Drawing Sheet

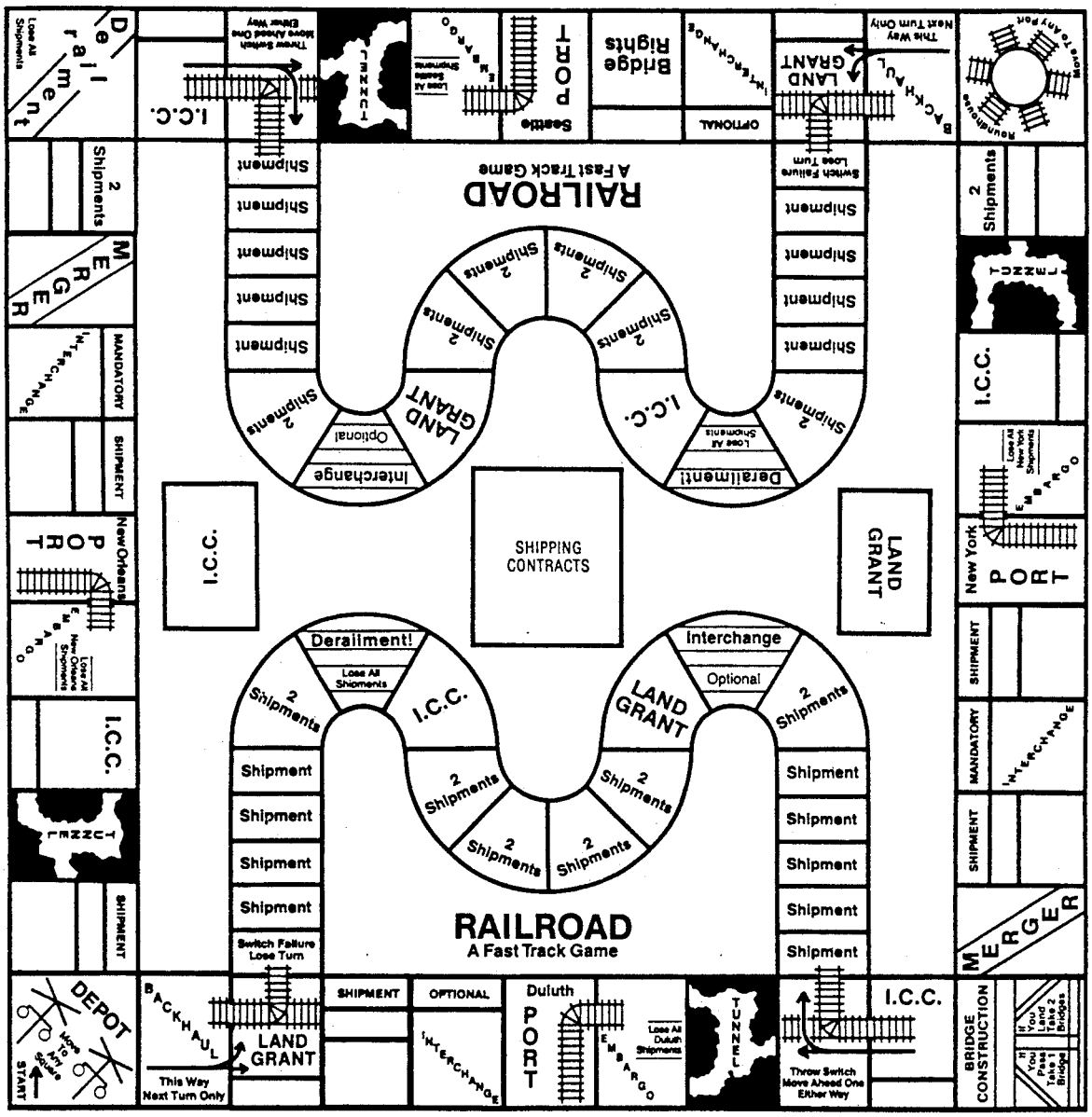
START
DEPOT
Move Ahead Any Space
BACKHAUL
This Way Next Turn Only
LAND GRANT
SHIPMENT
OPTIONAL
INTERCHANGE
Duluth
PORT
Lose All Duluth Shipments
EMBARGO
TUNNEL
Throw Switch Move Ahead One Either Way
I.C.C.
BRIDGE CONSTRUCTION
If You Land Here Take Bridge
If You Pass Here Take Bridge
MERGER
New York
PORT
Lose All New York Shipments
EMBARGO
TUNNEL
I.C.C.
2 Shipments
Switch Failure Lose Turn
Shipment
RAILROAD
A Fast Track Game
SHIPPING CONTRACTS
LAND GRANT
Interchange
Optional
Derailment!
Lose All Shipments
I.C.C.
2 Shipments
Switch Failure Lose Turn
Shipment
RAILROAD
A Fast Track Game
Derailment
Lose All Shipments
I.C.C.
2 Shipments
Interchange
Optional
LAND GRANT

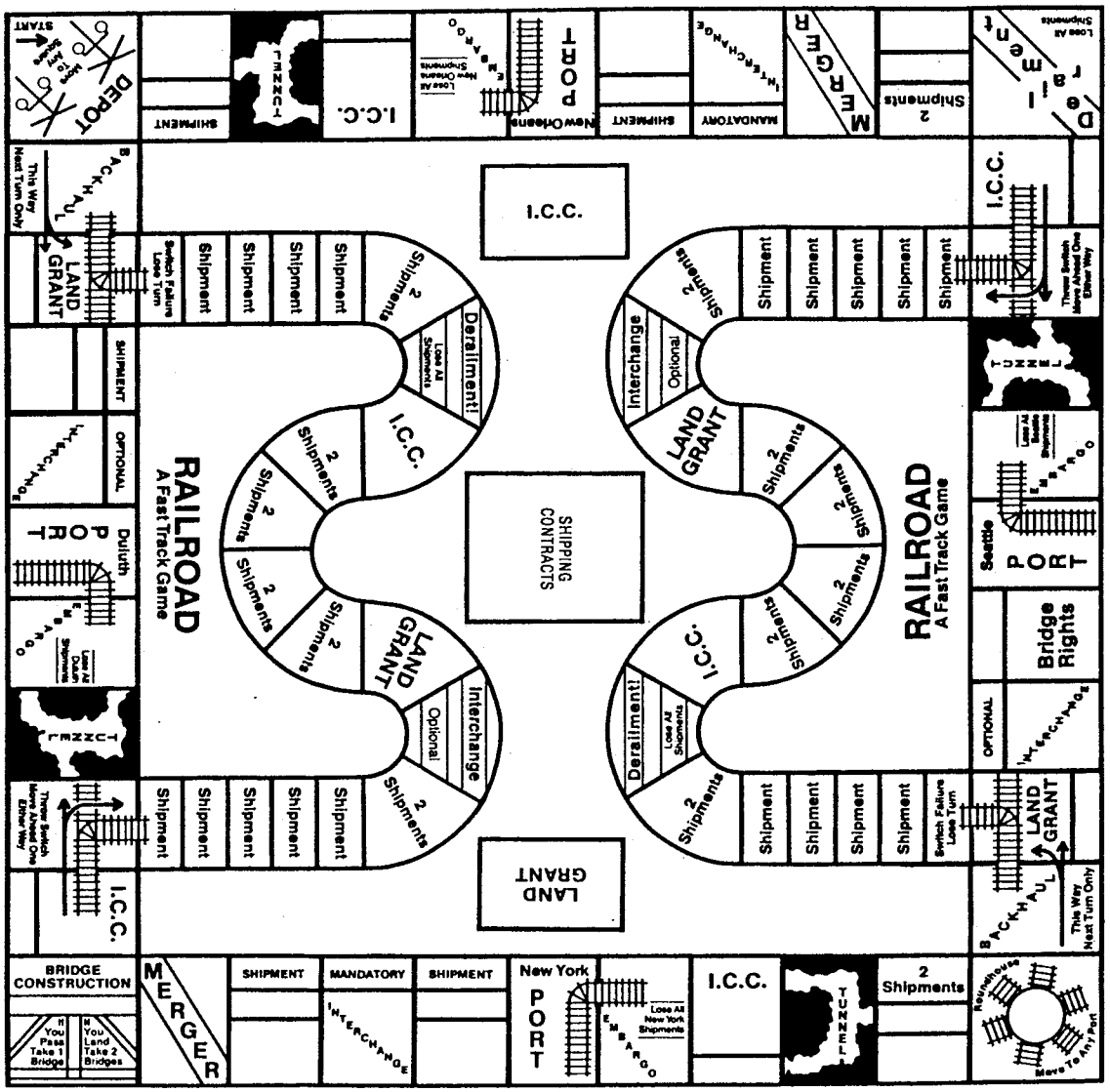
START
DEPOT
BACKHAUL
This Way Next Turn Only
LAND GRANT
SHIPMENT
OPTIONAL
INTERCHANGE
Duluth
PORT
EMBARGO
Lose All Duluth Shipments
TUNNEL
I.C.C.
Throw Switch Move Ahead One Either Way
BRIDGE CONSTRUCTION
If You Pass Take 1 Bridge
If You Land Take 2 Bridges
Switch Failure Lose Turn
2 Shipments
Shipment
RAILROAD
A Fast Track Game
Derailment!
Lose All Shipments
Interchange
Optional
SHIPPING CONTRACTS
MERGER
MANDATORY
New Orleans
New York
Lose All New York Shipments
Lose All New Orleans Shipments
Seattle
Bridge Rights
Lose All Seattle Shipments
Throw Switch Move Ahead One Either Way
Switch Failure Lose Turn
Lose All Shipments

METHOD OF PLAYING A BOARD GAME

This invention relates to a board game apparatus and a method of playing same. More particularly this invention relates to a board game apparatus and method having a transportation motif. Yet more particularly this invention contemplates a preferred railroading motif wherein the objective is the completion of a plurality of shipments or deliveries of commodities to a plurality of destinations.

REFERENCE TO RELATED DESIGN PATENT APPLICATION

Reference is made to applicant's related design patent, application Ser. No. 606,648 filed May 3, 1984, entitled "Board Game".

REFERENCE TO DOCUMENT DISCLOSURE

Reference is made to applicant's Document Disclosure submission number 121025 under the Patent and Trademark Office's Document Disclosure Program.

BACKGROUND OF THE INVENTION

Board games are, of course, well known. Board games such as "Monopoly" and "Parchesi" have been played by millions. More recently the game "Trivial Pursuit" has, in essence, started a resurgence of interest in such games. To the knowledge of applicant, none of these board games has attempted to provide an entertaining, realistic depiction of the transportation industry with all the attendant risks, rewards, excitment and therefore entertainment associated therewith.

BRIEF SUMMARY OF THE INVENTION

Briefly, in one aspect, the present invention is a board game apparatus or device having a transportation theme or motif. Specifically, the present board game comprises:

A transportation board game having as its object the completion of a plurality of deliveries to a plurality of destinations, the board game comprising:

a. means to generate random numbers which correspond to the number of steps a player may take during a move;
b. player markers;
c. a plurality of deliveries indicia means;
d. means to keep track of deliveries;
e. governmental regulation means;
f. business contingency means;
g. a game board on which the delivery routes are set out, the board having the features:
   i. a perimeter delivery route defined by a series of adjacent squares or stops on which player markers land and are counted in a move, the perimeter route lying substantially adjacent to the edge of the board;
   ii. at least one interior delivery route disposed within the perimeter route and defined by a locus of stops, the interior route communicating with said perimeter route defined in (g)(i) by means of intersection stops, the intersection stops permitting the player to choose either the interior or perimeter routes in completion of a move;
   iii. a plurality of destination stops;
   iv. a plurality of route modifying stops which provide for termination, redirection and inter-route exchange during a move;
   v. a plurality of stops which contemplate the execution of governmental regulations;
   vi. a plurality of business contingency stops which contemplate the execution of a business exigency;
   vii. stops which permit or require the exchange of delivery indicia means with other players; and
   viii. a plurality of stops which provide for the total loss of all delivery indicia means within the player's control.
h. stop abridgement means, said stop abridgement means permitting avoidance of the consequences of landing on a stop over which it is placed.

Another aspect of the present invention comprises a method of playing a game apparatus as above described. One embodiment of this method involves the utilization of a stop abridgement means wherein before the number of squares or stops to be traversed or counted during a move is determined, e.g., by rolling one or more dice, a decision is made to place one or more stop abridgement means over a stop that is likely to be traversed. Further, the length of time the game must be played can be adjusted before the start of play or during play by adjusting the number of deliveries which must be made for a player to win.

A "move" as the term is intended herein means the series of mental or physical acts subsequent to a player's release of his or her game marker until the suceeding player releases his or her marker. Thus a "move" is intended to include any decisions made and implemented before a random number generator (e.g., one or more dice) is employed to determine the number of stops (e.g., squares) that are to be traversed by the player's marker.

DESCRIPTION OF THE FIGURE

The enclosed FIGURE is a plan view of a preferred embodiment of the game board of the present invention.

DETAILED DESCRIPTION OF THE INVENTION

In accordance with the above-described brief summary of the invention, there is described herein the preferred railroad motif of the invention. It is to be understood that railroading is only the preferred motif from which the present invention is illustrated. Other transportation industries such as trucking, airline, shipping etc., will be suggested by the description below and the attached claims. These variations, which will be suggested by the preferred practice of the present invention are to be included within its scope.

Thus in the preferred mode of playing the present inventive game as described in the rules of the game set out below, two or more players select player markers. Player markers, which in the case of a railroad embodiment of the invention, would generally be the assortment of railroad cars that are seen in an average train. For example, player markers could be engines, cabooses, tank cars, flat cars or other types of cars in a train. Alternatively, (or in combination), a particular type of moveable railroad asset, e.g., an engine, could be employed and each player would be given a different color. Alternatively, different types of pawns or other markers could be used.

The game of this invention contemplates the utilization of a plurality of delivery indicia means. In a preferred practice of the invention, delivery indicia means would be a series of cards designated "shipping contracts" having indications thereon of the destination of the delivery as well as the commodity to be delivered. While the number of destinations, the number of cards per destination and the type of commodity are not critical, for ease of play four destinations have been found to be acceptable. About 60 shipping contracts have been found to be a sufficient number to permit typical numbers of players (e.g., 2, 3 or 4) to have sufficient shipping contracts so that they will not run out.

In the preferred practice of this invention, it is necessary for a designated player to keep track of the number of deliveries that a player has made. Thus, for example, it is convenient for deliveries to be kept track of by means of a tablet. Note that all players are at all times cognizant of the number of completed deliveries each player has made. This is also one of the important characteristics of the play of this invention; that is, by prior or subsequent agreement, the players may change the number of completed deliveries that must be made to each port for that player to be declared the winner. Typically, 10 deliveries to each of the four ports provides a length of play of about 1 to 2 hours. Obviously, the number of deliveries necessary to win could be adjusted during the play if the game became too long or not long enough.

The preferred practice of this invention requires the presence of governmental regulation means. Governmental regulation means are intended to provide the reality associated with running a governmental regulated transportation business. Governmental regulation means, in this preferred railroad practice are Interstate Commerce Commission (ICC) Cards. Obviously, if other transportation themes are chosen there are likely to be respective federal or state governmental regulators which would issue orders. A typical (but by no means exhaustive) set of ICC cards is as follows:

| Number of Cards ICC | | Instructions |
|---|---|---|
| 2 | ORDER | Move to any Mandatory Interchange Square. |
| 1 | ORDER | ICC Grants Direct Access to Seattle and Duluth. Move to Either one. |
| 1 | ORDER | ICC Grants Direct Access to New Orleans and New York. Move to Either one. |
| 2 | ORDER | Move to any Optional Interchange Square. |
| 2 | ORDER | ICC Delays Your Rate Increase. Move Back 4 Spaces. |
| 2 | ORDER | ICC Grants Round-About-Route. Move to any Square. |
| 2 | ORDER | ICC Approves Your Merger. Move to any Merger Square. |
| 2 | FUTURE ORDER | Before Your Turn, Move to any Mandatory Interchange Square. |
| 2 | FUTURE ORDER | Refuse Interchange. (Use Anytime you Don't Want to Interchange) |
| 2 | FUTURE | Congress Deregulates the Railroads. |

-continued

| Number of Cards ICC | | Instructions |
|---|---|---|
| | ORDER | Before Your Turn, Take 2 Shipments. |
| 2 | FUTURE ORDER | WILDCAT STRIKE! The Player you Pick Loses Next Turn. Play Anytime. |
| 2 | FUTURE ORDER | ICC Lifts Embargo. You Keep the Shipments You'd Otherwise Lose After Landing on an Embargo Square. |

The preferred practice of the presently-described railroad transportation board game also requires the utilization of business contingency means. This practice is referred to as "Land Grant" cards. Land Grant cards are intended to provide another element of reality in that they set forth some of the business contingencies that might arise while running a railroad. Business contingency means are distinguishable from the administrative regulation means by virtue of the fact that one is governmentally originated and the other arises by virtue of private transactions between railroads. A representative set of Land Grant cards is as follows:

| Number of Cards Land Grant | Instructions |
|---|---|
| 2 | Industry Wide Strike! All Players Roll One Die. Highest Number Loses Turn. (Ties Roll Again) |
| 2 | Business is off. Move Back 1 Square for Every Shipment you Have. |
| 1 | Flash Flood Washes out Bridge. Lose one Bridge. |
| 1 | Railroad Wars! Steal all Shipments From the Player 1st to Your Left. |
| 1 | James J. Hill Trust Comes Through. Free Turn. |
| 1 | Vanderbilt Trust Comes Through. Free Turn. |
| 2 | OPEC Lowers Price of Oil. Move Ahead 2. |
| 2 | Railroad Wars! Sneak Attack! You Steal 1 Shipment (Your Choice) From Each Player. |
| 2 | Business Picks up. Take 1 Shipment. Then Move Ahead 1 Square for Every Shipment you Have. |
| 2 | Economic Recovery. Take 2 Shipping Contracts. |
| 2 | Merger Talks. Move to a Merger Square. (Your Choice) |
| 1 | River Barge Hits Bridge. Lose one Bridge. |

The game board to be utilized in the preferred practice of the present invention is depicted in the attached FIGURE. As shown, play begins from the lower right hand corner of the board at the "Depot" square or stop. An airport or trucking terminal, for example, could be the starting square or stop if other transportation themes were chosen. Play begins with clockwise movement of the player's piece and continues generally clockwise until a change in direction is ordered or permitted by some indication of either the stop on which the player comes to rest or is permitted or required by some administrative regulation or business contingency. The preferred rules of play are set forth as follows:

RULES OF PLAY

| | |
|---|---|
| OBJECT | As the operator of a railroad, to be lst to deliver 10 shipments to each of the 4 ports on the game board-New York, New Orleans, Seattle and Duluth. |
| METHOD | Each player moves a train around the board picking up shipments. A shipping contract for each identifies the port to which it is destined. |

EQUIPMENT

| | |
|---|---|
| Dice | 60 Shipping Contracts |

-continued

| | |
|---|---|
| | 30 Bridges ICC and Land Grant Cards<br>4 Pawns Trainmaster Tally Sheets |
| | PLAYING THE GAME |
| STARTING | Shipping Contracts, ICC cards and Land Grant cards are place in stacks at the appropriate spots on the board. Each player selects a pawn, takes 3 bridges and 3 shipping contracts. One player is designated "Trainmaster" to record deliveries on a tally sheet. Play begins at the Depot. Two die are used and the highest roll starts. Move clockwise. |
| OBTAINING & DELIVERING SHIPMENTS | Shipments are obtained by landing on shipment squares. Upon landing, take the number of shipment contracts, 1 or 2, indicated by the square. Contracts must be displayed near a player, information side up.<br>The destination of a shipment is identified by its contract. Delivery is mandatory and is made by landing on, being on or passing over the port to which it is destined. If delivering by passing over, deliver first, then play the square landed upon, past the port.<br>All shipments must be delivered and the Trainmaster records each one. Delivered contracts are held by the Trainmaster who reshuffles after going through the stack. |
| BRIDGES | Bridges are used to avoid undesirable squares for oneself or to make your opponents pass over desirable ones. A bridge can be laid on any square except ports. The bridged square is out of play-not counted-until passed by any player. Once passed, the bridge is removed and returned to storage in the game box. Before his or her turn, a player can lay 1 or 2 bridges. |
| | RULES OF THE ROAD |
| | If a square or card says go to another square, move directly there, playing no other enroute. Piggyback Rule: If you shake doubles ("piggybacks"), take 1 contract before moving. |
| | PLAYING THE SQUARES |
| BACKHAUL | For your next turn only move in reverse. |
| BRIDGE | Take 1 bridge if you pass and 2 if you land here. |
| CONSTRUCTION | They must be taken before the next throw of the dice. |
| BRIDGE RIGHTS | e a bridge before the next throw of the dice. |
| DEPOT | Start the game here. Thereafter, if you land, immediately move to any other square. |
| DERAILMENT | You lose all your shipments. Turn them over to the Trainmaster. |
| EMBARGO | Lose the contracts you have for the port indicated by the square. Turn them over to the Trainmaster. |
| ICC | Take the top ICC (Interstate Commerce Commission) card. There are 2 types, "Orders" and "Future Orders". Follow the instructions on Order cards immediately. Future Orders are used at the times instructed by the cards, and they may be saved. |
| LAND GRANT | Take the top Land Grant card. Follow the instructions immediately. |
| MANDATORY INTERCHANGE | If you have at least one contract, choose another player who has at least one. If these requirements cannot be met, play of the square ends. If met, exchange all your contracts for all those of the selected player, unless an ICC "refuse interchange" card is used. Play ends with either the exchange itself or use of the card. |
| MERGER | Take 2 contracts. Then "merge" by moving to and playing any square on which there is another player. |
| OPTIONAL INTERCHANGE | Same as Mandatory Interchange (see above), except the exchange is optional on your part. |
| PORTS | Deliver shipments by landing on, being on or passing over the port. |
| ROUNDHOUSE | You must immediately move to any port. |
| SHIPMENT | Take 1 shipping contract. |
| 2 SHIPMENTS | Take 2 shipping contracts. |
| SWITCH FAILURE | Lose your next turn. |
| THROW SWITCH | After landing, immediately move ahead one, either way. |
| TUNNELS | After landing, immediately move to another tunnel from where your next turn will be taken. |
| | ADJUSTING PLAYING TIME |
| | Playing time can be adjusted by increasing or |

-continued

| |
|---|
| decreasing the number of delivered shipments needed to win. Change the number before and/or during play, by agreement. |

From the above description of play and examination of the game board as set forth in the FIGURE, several observations may be made. First, perimeter and interior routes are defined by the locus of stops or squares, the selection of which is left to the discretion of the player. Further, there are circumstances, such as with a real train, when backing up or reversal of direction is permitted or required. Third, this invention provides for the utilization of stop abridgement means which in this embodiment is bridges. Utilization of stop abridgement means contemplated herein permits the player to avoid the unfavorable consequences indicated on a square or stop forseeably within the number of squares likely to be traversed. Also a stop abridgement means could be strategically employed to prevent another player from obtaining the possible favorable consequences permitted or required by a square or stop likely to be landed on during that player's move. Thus the utilization of stop abridgement means provides an element of excitment and strategy that applicant does not believe to have been disclosed in previous game boards. Obviously, in some other transportation industry something other than bridges could be employed. For example, "port shut-down" (e.g. frozen) could be used in the shipping industry or "fogged-in airport" could be used in the airline industry. In any event, it is important that such stop abridgement means be placed on the board before the player utilizes the dice to determine the number of squares that are to be traversed. This pre-thinking step is also believed to be a novel and unobvious feature of the present invention.

Having thus described my novel game apparatus and a preferred method for playing same, I claim as my invention as follows:

1. A method of playing a board game in which a move comprises the steps of:

a. placement of one or more stop abridgement means, the stop abridgement means permitting avoidance of any consequences of the stop over which it is placed;

b. operating a means to generate the number of steps to be traversed during the move by a player's marker; and, if the stop abridgement means is traversed;

c. removing the stop abridgement means from play and avoiding the consequences of the stop on which it was placed.

2. A method according to claim 1 wherein the stop abridgement means is a bridge.

3. A method according to claim 1 wherein the means to generate the number of steps to be traversed is at least one die.

4. A method according to claim 1 wherein the stop abridgement means is placed to avoid the consequences of a stop over which the player placing the stop abridgement means is likely to travel when that player moves its marker.

5. A method according to claim 1 wherein the stop abridgement means is placed so that the consequences of a stop are to be avoided by a player other than the player placing the stop abridgement means.

6. A method according to claim 1 wherein avoiding the consequences of the stop over which the stop abridgement means is placed includes excluding the abridged stop in moving the player marker.

* * * * *